US006071213A

United States Patent [19]

Raasch et al.

[11] Patent Number: 6,071,213

[45] Date of Patent: Jun. 6, 2000

[54] TRAMPOLINE CONVERTIBLE FOR USE AS SWIMMING POOL

[75] Inventors: Jason J. Raasch, Arlington Heights; Andrey E. Frolov, Glenview, both of Ill.

[73] Assignee: Midwest Air Technologies, Inc., Lincolnshire, Ill.

[21] Appl. No.: 09/055,635

[22] Filed: Apr. 6, 1998

[51] Int. Cl.[7] ..... A63B 5/11; E04H 4/00

[52] U.S. Cl. ..... 482/29; 482/27; 4/506; 220/9.4

[58] Field of Search ..... 482/26–29, 55, 482/77, 111; 4/494–496, 488, 489, 506; 220/9.1, 9.4, 495.01, 495.11; 182/139

[56] References Cited

U.S. PATENT DOCUMENTS

| | | | |
|---|---|---|---|
| 2,324,970 | 7/1943 | Woolley | 482/29 |
| 2,378,159 | 6/1945 | Royer | 220/9.1 |
| 2,567,514 | 9/1951 | Hoffman | 4/587 |
| 2,580,942 | 1/1952 | Murad et al. | 4/506 |
| 2,749,956 | 6/1956 | Eldred | 220/9.3 |
| 3,031,688 | 5/1962 | Southwood | 182/139 |
| 3,233,251 | 2/1966 | Barrera | 4/506 |
| 3,648,303 | 3/1972 | Stewart et al. | 4/506 |
| 4,356,933 | 11/1982 | Connolly | 4/506 |
| 4,393,528 | 7/1983 | West | 4/498 |
| 4,576,375 | 3/1986 | Roberts | 482/27 |
| 4,900,011 | 2/1990 | Nolet | 482/29 |
| 5,592,702 | 1/1997 | Gillebaard, Jr. | 4/506 |

FOREIGN PATENT DOCUMENTS

| | | | |
|---|---|---|---|
| 2684882 | 6/1993 | France | 482/27 |
| 93/16762 | 9/1993 | WIPO | 482/27 |

*Primary Examiner*—Richard J. Apley
*Assistant Examiner*—Victor Hwang
*Attorney, Agent, or Firm*—Greer, Burns & Crain, Ltd.

[57] ABSTRACT

A trampoline convertible for use as a swimming pool includes a substantially rigid frame having a top member, a bottom member and a plurality of posts fixed between the top member and the bottom member to secure the members in spaced relationship to each other. A mat having a perimeter is planarly suspended relative to the top member. Also included is a shell having an outer perimeter and being insertable within a space defined by the frame. A plurality of shell attaching devices secures the shell to the frame. Overlapping the shell, a liner is included which is also positionable within the space defined by the frame. A plurality of liner attaching devices secures the liner to the frame. The trampoline is converted to a swimming pool by inverting the trampoline, securing the shell and the liner to the frame, and introducing water into the space defined by the frame and within the liner.

16 Claims, 3 Drawing Sheets

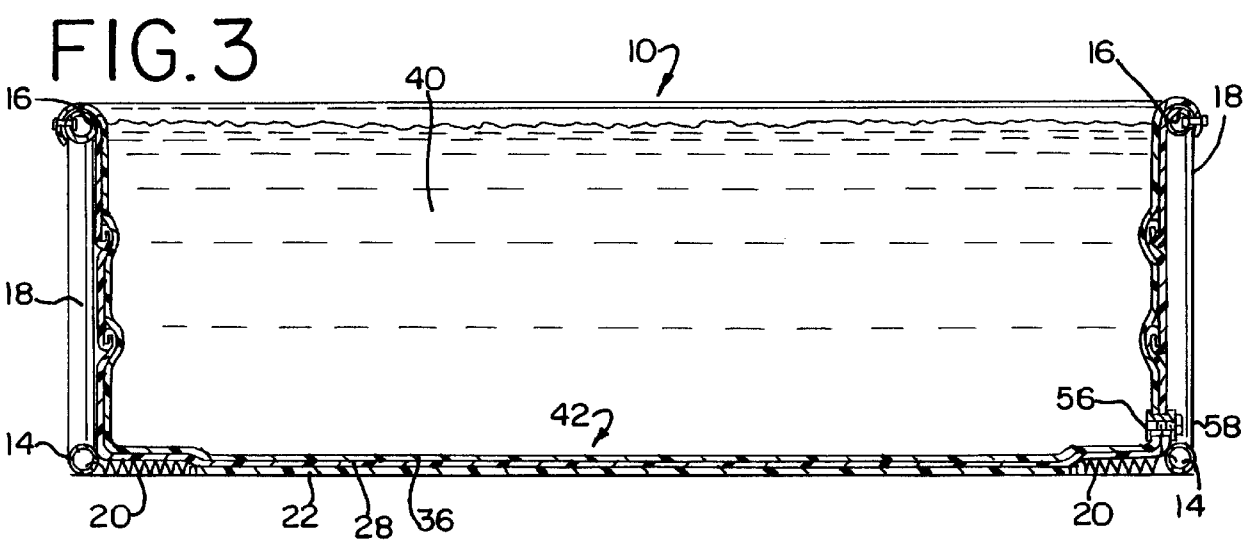
FIG. 3
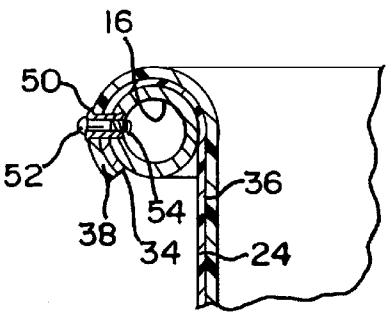
FIG. 6
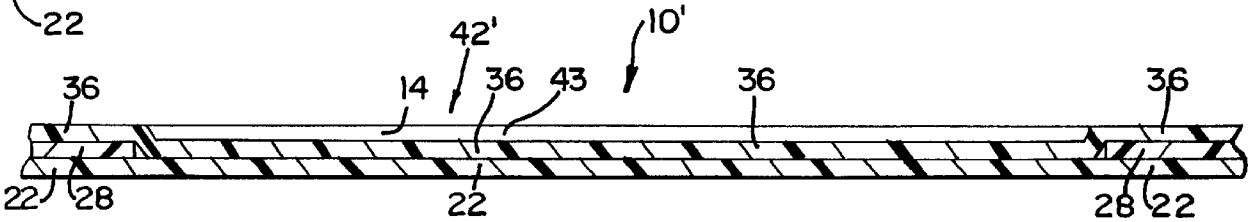
FIG. 4
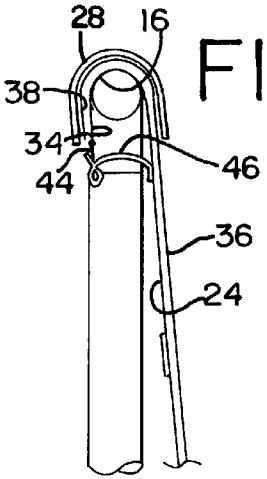
FIG. 5
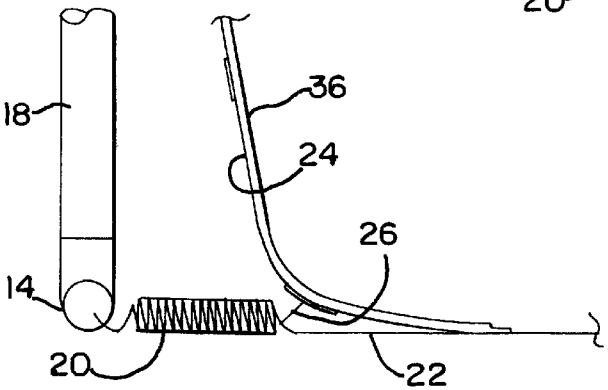

TRAMPOLINE CONVERTIBLE FOR USE AS SWIMMING POOL

BACKGROUND OF THE INVENTION

This invention generally relates to trampolines, and specifically to a trampoline which is convertible for use as a swimming pool.

In the category of relatively inexpensive portable backyard swimming pools having depths of generally less than 4 feet, the pools are generally of the inflatable type that requires inflation by the user, or the type that is made from a single-piece of molded plastic. The disadvantage of the inflatable type pools is that a strenuous physical effort is required in inflating the pool, especially if no inflating devices are available. Even if a manual pump is employed, some physical exertion is still necessary to operate the pump. Electric pumps or compressors would make inflating the pool easier. However, average pool users do not own such relatively expensive equipment. Aside from being prone to air leaks, the disadvantage of inflatable pools is that the walls of these pools normally cannot support the weight of the users, and as a result, the walls could collapse and spill the water. The same disadvantage is found in molded pools.

Another disadvantage of conventional above ground portable pools, and of back yard type trampolines, is that many homeowners do not have sufficient yard space to utilize both the pool and the trampoline. Consequently, they have to forego one piece of recreational equipment for the other.

Yet another disadvantage of conventional above ground pools is that the season in which these pools can be utilized is relatively short in many parts of the country. As a result, this rather substantial structure must be dismantled and/or stored for much of the year.

Thus, it is a first object of the present invention to provide an improved trampoline which is readily convertible for use as an above ground swimming pool.

It is another object of the present invention to provide an improved above ground swimming pool which does not require inflation by the user.

Still another object of the present invention is to provide an improved above ground swimming pool having a wall with sufficient rigidity to support the weight of the user.

BRIEF SUMMARY OF THE INVENTION

The above-identified objects are met or exceeded by the present trampoline which is convertible for use as a swimming pool. The trampoline has a conventional trampoline mat attached at its periphery to a rigid frame which, when inverted, forms a frame for a swimming pool. A support shell of reinforced, water resistant fabric type material is secured to the frame to define an enclosure. A waterproof liner is then secured to the frame within the enclosure for retaining water.

More specifically, the present invention provides a trampoline convertible for use as a swimming pool, which includes a substantially rigid frame having a top member, a bottom member and a plurality of posts fixed between the top member and the bottom member. A mat having a perimeter is planarly suspended relative to the top member. A waterproof liner is provided, and is insertable within a space defined by the frame. A plurality of liner attaching devices secures the liner to the frame. To convert to a swimming pool, the frame is inverted, the liner is secured to the frame and water is introduced into the space defined by the frame and within the liner.

In the preferred embodiment, also included is a shell which is insertable within the space defined by the frame and between the liner and the frame. The shell supports the liner against the weight of the water. A plurality of shell attaching devices secures the shell to the frame.

BRIEF DESCRIPTION OF THE SEVERAL VIEWS OF THE DRAWINGS

FIG. 3 is a sectional view of the swimming pool taken along line 3—3 of FIG. 2 and in the direction generally indicated;

FIG. 4 is an enlarged partial sectional view of the bottom of the swimming pool of FIG. 3 showing an alternate embodiment of the shell;

FIG. 5 is an enlarged partial view of FIG. 3 without water, showing the shell and the liner secured to the frame of the swimming pool; and FIG. 6 is an enlarged partial vertical sectional view of FIG. 3 showing an alternate embodiment for securing the shell and the liner to the frame.

DETAILED DESCRIPTION OF THE INVENTION

Figure 1:
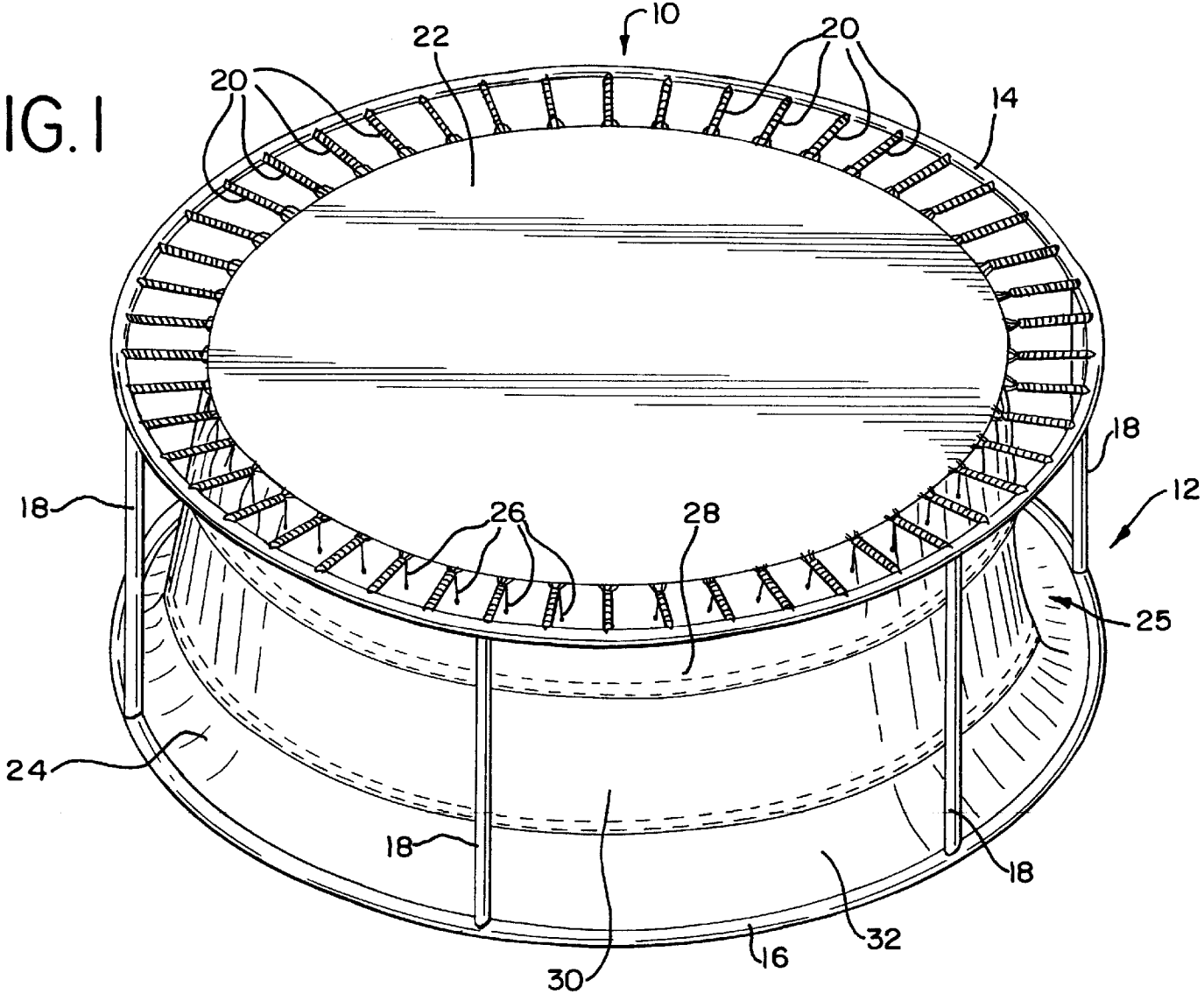
FIG. 1 is a perspective view of a trampoline embodying the present invention.

Referring to FIG. 1, a trampoline which is convertible as swimming pool is shown and generally designated 10. The trampoline 10 is provided with a substantially rigid frame 12 which includes a preferably circular top member or ring 14 and a preferably circular bottom member or ring 16, which is generally concentric to the top member 14. Several generally upright posts 18, six in the preferred embodiment, attached at respective ends to the top and the bottom members 14, 16 are also included in the frame 12. The frame 12 is preferably made of light weight tubular galvanized metal to withstand both corrosion and the forces exerted upon frame during use, whether as a trampoline or as a swimming pool. Alternatively, the frame 12 could also be made of plastic or fiber glass. It should be noted that while the preferred frame 12 has a circular shape, it may have any of variety of different shapes, for example an oval or a polygon such as a square or a rectangle.

A trampoline mat 22 is held suspended within a space defined by the top member 14 via a plurality of coil springs 20. One end of each of the springs 20 is attached to the perimeter of the mat 22 and the other end is connected to the top member 14, so that the mat is planarly suspended by the tension of the springs, as is well known in the art. The mat 22 is preferably made of canvas or reinforced synthetic material such as nylon. In shape, the mat 22 generally corresponds to the shape of the top member 14, although shapes not corresponding to the top member are also contemplated, for example, a square or a rectangular mat disposed within a circular top member.

A shell 24 is provided within a space 25 generally defined by the frame 12 and is secured to the springs 20, the frame 12 or the mat 22, preferably via a plurality of straps 26 or their equivalent. The shell 24 and the straps 26 are preferably made from the same material from which the mat 22 is made. The straps 26 generally correspond in number to the number of springs 20 and are preferably attached at one end to the mat 22 at locations that coincide with the location where the springs 20 are attached. The other end of each of the straps 26 is attached to the shell 24 generally along the perimeter of the mat 22. As such, when the invention is being used as the trampoline 10, the shell 24 hangs from the mat 22 by the straps 26, which leave enough space between mat 22 and shell 24 to allow air to circulate in and out during use. When the invention is being used as a swimming pool (best seen in FIG. 2), the shell rests on the mat 22 and the straps 26 are disposed under the shell and retain the shell within the space 25.

In the preferred embodiment, the shell 24 includes several pieces, three of which are shown and are tiered for providing strength and support to the trampoline 10 when used as a pool and filled with water. Additional tiers are contemplated in situations where narrower widths of shell material are available. A top portion 28 is generally circular and somewhat larger than the mat 22. An intermediate portion or sleeve 30 is an annular circular band which at an inner, longitudinal edge is sewn or glued to the perimeter of the top portion 28. A bottom portion or sleeve 32, which is also an annular band, is sewn or glued at an inner, longitudinal edge onto an outer peripheral, longitudinal edge of the intermediate sleeve 30. The other longitudinal edge of the bottom sleeve 32, which is also the outer perimeter 34 of the shell 24 taken as a whole, is secured to the lower member 16. The tiered construction of the portions 28, 30, 32 relates to the generous overlap between adjacent longitudinal edges (best seen in FIG. 2). The portions 28, 30, 32 of the shell 24 are folded into each other so that there are 4 layers of the shell material of each of the overlapped areas. In this manner, the shell 24 effectively acts as the wall of the swimming pool (best seen in FIG. 2) for holding water. The overlapped areas reinforces the shell 24 against the water pressure. It is contemplated that there may be additional portions 28, 30, 32 and that each of the portions 28, 30 and 32 may be made of several smaller pieces fastened together, as by stitching.

Figure 2:
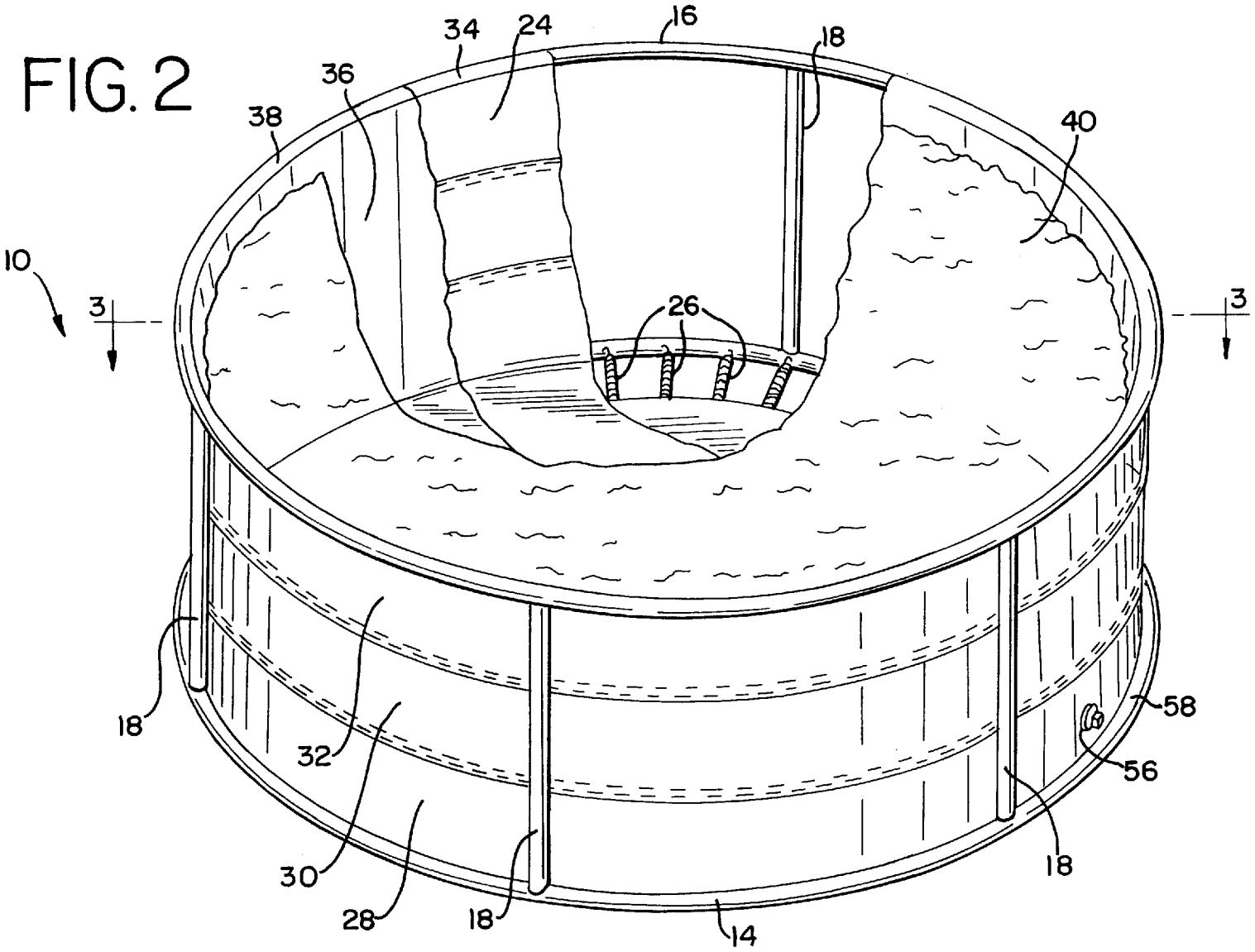
FIG. 2 is a perspective view of the trampoline of FIG. 1 being used as a swimming pool, with portions removed to show the liner and the shell.

Referring now to FIG. 2, the trampoline 10 of FIG. 1 is shown inverted so that the bottom member 16 is on the top and the top member 14 is on the bottom. In this manner, the trampoline 10 is adapted to be used as a swimming pool (the trampoline 10 will hereinafter be referred to as a swimming pool 10, when applicable). It is contemplated that the shell may be made water tight to receive water when the trampoline is used as a pool. However, in the preferred embodiment, in addition to the shell 24, a waterproof liner 36 is provided and overlaps the shell to hold the water within the frame 12 when the invention is used as the swimming pool 10. The liner 36 is preferably made from a single-piece of polypropylene, and its perimeter 38, similar to the perimeter 34 of the shell 24, is secured to the bottom frame member 16 (which is also the top rail of the swimming pool 10).

It will be seen in FIG. 2 that once the swimming pool 10 is filled with water 40, the water pressure forces the liner 36 outwardly against the shell 24, which in turn is forced against the vertical posts 18, thereby forming a shape which is substantially the same as the space 25 defined by the frame 12. The shell 24 is designed to be strong enough to support the filled liner 36 and to distribute the weight of the water evenly around the frame. The tiered construction of the shell 24, i.e., the sewn or glued overlapping portions 28, 30, 32 of the shell, facilitates this support feature.

Referring now to FIG. 3, a sectional view of the swimming pool 10 is shown. In the embodiment shown in FIG. 3, a bottom 42 of the pool 10 includes the liner 36 overlapping the top piece 28 of the shell 24, which overlaps the mat 22. In another embodiment, shown in FIG. 4 and generally designated 10', components of the swimming pool 10 which are identical to those of FIG. 3 are designated with identical reference numbers. The main difference between the swimming pool 10 of FIG. 3 and the swimming pool 10' of FIG. 4 is that in the latter, an opening 43 is defined in the top portion 28 of the shell 24 at the bottom 42' of the pool to conserve shell material and to make the pool lighter. In this embodiment, the support for the bottom of the liner 36 is provided by the mat 22. Thus, the liner 36 directly overlaps the mat 22 in that area.

Referring now to FIG. 5, the preferred embodiment for securing the shell 24 to the bottom member 16 includes wrapping the perimeter 34 of the shell around an outside of the bottom member sufficiently to fold back or overlap the shell. Buckles 44 are sewn or glued onto the shell 24 along its perimeter 34, preferably in evenly spaced apart relationship. Securing straps 46, which at one end are sewn or glued to opposing portions of the shell 24, are then buckled to the buckles 44 at the other end.

The liner 36 is secured to the bottom member 16 by having its perimeter 38 wrapped around the outside of the bottom member 16 and overlapping the shell 24. The liner 36 is kept in place by a clamp 48 which is preferably made of plastic and configured for gripping the bottom member 16 substantially along its entire length, thereby securing the liner and the shell 24 to the bottom member. While the clamp 48 is preferably a single piece that corresponds in size and shape to the bottom member 16, it can also be in several pieces which when clamped onto the bottom member, form a shape which is substantially the same as the single piece version. It is also contemplated that the clamp 48 be covered with a resilient coating (not shown) to serve as a cushion for swimmers resting on the bottom member 16.

Turning now to FIG. 6, an alternative embodiment for securing the shell 24 and the liner 36 to the bottom member 16 includes wrapping the respective perimeters 34, 38 of the shell and the liner around the outside of the bottom member. Grommets or eyelets 50 are provided on the portion of the shell 24 and liner 36 that extend over and contacts the bottom member 16. A bolt 52 is then screwed into holes 54 which are predrilled into the bottom member 16. The holes 54 are preferably spaced evenly apart along the bottom member 16.

In another embodiment (not shown), straps are attached to the outer perimeters 34, 38 of the shell and the liner 24, 36, and these straps are secured the bottom member 16 using the grommet and bolt arrangement described above. In yet another embodiment (not shown), strings or straps could be attached to the shell 24 and the liner 36, and weaved through predrilled holes in the posts 18.

As shown in FIGS. 2 and 3, the swimming pool 10 also includes a drain 56 and a plug 58 near the bottom 42 or the top member 14 of the pool 10. The drain 56 extends through both the shell 24 and the liner 36 to allow the water 40 to drain when the plug 58 is removed.

It will be appreciated that a significant advantage of the present invention is that the trampoline can be easily converted to be used as the swimming pool. Another advantage is that it is not necessary to inflate the swimming pool. Yet another advantage is that the frame is strong enough to support the weight of the users sitting on the frame, whether in the pool or trampoline mode. Thus, users can more efficiently use the present invention for more of the year, and in yards where space is at a premium.

While particular embodiments of the trampoline of the invention have been shown and described, it will be appreciated by those skilled in the art that changes and modifications may be made thereto without departing from the invention in its broader aspects and as set forth in the following claims.

We claim:

1. A trampoline convertible for use as a swimming pool, comprising:

a substantially rigid frame having a top member, a bottom member and a plurality of posts fixed between said top member and said bottom member to secure said members in spaced relationship to each other;

a trampoline mat having a perimeter and being planarly suspended relative to said top member;

a shell being insertable within a space defined by said frame, said shell having a first shell portion including an outer perimeter and an inner edge and a second shell portion having an outer perimeter and an inner edge, said inner edge of said first shell portion being attached to said outer perimeter of said second shell;

shell attaching means for securing said first shell portion to said frame;

a liner having a perimeter and being insertable within said space defined by said frame; and liner attaching means for securing said liner to at least one of said frame and said shell;

wherein said trampoline is convertible to the swimming pool by inverting said frame, securing said liner to at least one of said frame and said shell and introducing water into said space and within said liner.

2. The trampoline as defined in claim 1 further including a third shell portion having an outer perimeter, and wherein said inner edge of said second shell portion is attached to said outer perimeter of said third shell portion.

3. The trampoline as defined in claim 2 further including a plurality of attaching straps, and wherein said third shell portion includes an inner edge, said plurality of straps are configured to attach said third shell portion to said mat, and said shell attaching means is configured to secure said outer perimeter of said first shell portion to said bottom member.

4. The trampoline as defined in claim 2 further including a plurality of attaching straps constructed and arranged for attaching said third shell portion to said mat, and wherein said shell attaching means secures said outer perimeter of said first shell portion to said bottom member.

5. The trampoline as defined in claim 1, wherein said shell attaching means secures said outer perimeter of said first shell portion to said frame by fastening said outer perimeter onto said bottom member.

6. The trampoline as defined in claim 1, further including a plurality of attaching straps for attaching said shell onto said mat.

7. The trampoline as defined in claim 1 wherein said shell attaching means secures said first shell portion to said frame by fastening said outer perimeter of said first shell portion onto said first shell portion after said outer perimeter of said first shell portion is wrapped over said bottom member.

8. The trampoline as defined in claim 7 wherein said shell attaching means includes a plurality of buckles attached to said outer perimeter of said first shell portion, and a plurality of corresponding straps respectively attached to said first shell portion so that said buckles and said straps are positioned on opposing sides of said bottom member when said outer perimeter of said first shell portion is wrapped over said bottom member.

9. The trampoline as defined in claim 1 wherein said liner attaching means is configured to secure said perimeter of said liner to said frame by fastening said liner onto said bottom member.

10. The trampoline as defined in claim 9 wherein said liner attaching means includes a clamp for securing said liner to said frame.

11. The trampoline as defined in claim 1, wherein at least one of said first shell and said liner includes a drain.

12. The trampoline as defined in claim 1 wherein said mat is suspended relative to said top member by a plurality of springs connected at one end to said perimeter of said mat and the other end to said top member.

13. The trampoline as defined in claim 1 further including a plurality of attaching straps for attaching said shell onto a trampoline mat.

14. A structure for use as a swimming pool and a trampoline, comprising:

a substantially rigid frame having a top member, a bottom member and a plurality of posts fixed between said top member and said bottom member to secure said members in spaced relationship to each other;

a mat being planarly and fixably suspended relative to said top member;

a shell being insertable within a space defined by said frame;

shell attaching means for securing said shell to said frame;

a liner having a perimeter and being insertable within said space defined by said frame and overlapping said shell; and liner attaching means for securing said liner to said frame;

wherein said structure is configured for use as the trampoline when said frame rests on said bottom frame member, and said mat is planarly suspended above a substrate relative to said top member, and said structure is configured to be convertible for use as the swimming pool by inverting said structure so that said frame rests on said top frame member, said shell is positioned over said mat and said shell and said liner are secured to said frame and water may be introduced into said space and within said liner.

15. A trampoline convertible for use as a swimming pool, comprising:

a substantially rigid frame having a top member, a bottom member and a plurality of posts fixed between said top member and said bottom member to secure said members in spaced, parallel relationship to each other;

a trampoline mat having a perimeter and being planarly suspended relative to said top member by a plurality of springs connected at one end to said perimeter of said mat and the other end to said top member;

a shell having an outer perimeter and disposed within said frame;

shell attaching means for attaching said outer perimeter of said shell to said bottom member;

a plurality of attaching straps for attaching said shell to said mat;

a liner having a perimeter disposed within said frame and overlapping said shell; and liner attaching means for attaching said perimeter of said liner to said bottom member;

wherein said trampoline is converted to the swimming pool when said trampoline is inverted so that said top member and said mat becomes a bottom of the swimming pool and water is introduced into a space defined by said liner.

16. A kit for converting a trampoline for use as a swimming pool, the trampoline including a substantially rigid frame having a top member, a bottom member and a plurality of posts fixed between said top member and said bottom member to secure said members in space relationship to each other, and a trampoline mat having a perimeter and being planarly suspended relative to said top member, said kit comprising:

a shell having an outer perimeter and being insertable within a space defined by the frame, said shell having a first shell portion and a second shell portion having an outer perimeter and an inner edge, and wherein said first shell portion includes an inner horizontal edge attached to said outer perimeter of said second shell portion;

shell attaching means for securing said first shell portion to the frame; and a liner having a perimeter and being insertable within said space defined by the frame;

wherein the trampoline is convertible to the swimming pool by inverting the frame, securing said liner to at least one of the frame and said shell and introducing water into said space and within said liner.

* * * * *